US010815705B2

(12) United States Patent
Puscas et al.

(10) Patent No.: US 10,815,705 B2
(45) Date of Patent: Oct. 27, 2020

(54) VEHICLE DOOR HANDLE

(71) Applicant: Ford Global Technologies, LLC, Dearborn, MI (US)

(72) Inventors: Livianu Dorin Puscas, Rochester Hills, MI (US); Kosta Papanikolaou, Huntington Woods, MI (US); Rajesh K. Patel, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 78 days.

(21) Appl. No.: 16/059,528

(22) Filed: Aug. 9, 2018

(65) Prior Publication Data

US 2018/0347242 A1 Dec. 6, 2018

Related U.S. Application Data

(63) Continuation of application No. 14/289,929, filed on May 29, 2014, now Pat. No. 10,072,448.

(51) Int. Cl.

| | |
|---|---|
| ***E05B 85/14*** | (2014.01) |
| ***E05B 85/16*** | (2014.01) |
| ***E05B 79/22*** | (2014.01) |
| ***E05B 77/04*** | (2014.01) |
| ***E05B 79/20*** | (2014.01) |

(52) U.S. Cl.

CPC ..... *E05B 85/14* (2013.01); *E05B 77/04* (2013.01); *E05B 79/20* (2013.01); *E05B 79/22* (2013.01); *E05B 85/16* (2013.01); *Y10T 292/57* (2015.04)

(58) Field of Classification Search

None

See application file for complete search history.

(56) References Cited

U.S. PATENT DOCUMENTS

| | | | |
|---|---|---|---|
| 3,990,531 | A | 11/1976 | Register |
| 4,683,774 | A | 8/1987 | Memmola |
| 5,037,145 | A | 8/1991 | Wilkes |
| 5,123,687 | A | 6/1992 | Pfeiffer et al. |
| 5,669,642 | A | 9/1997 | Kang |
| 5,887,918 | A | 3/1999 | Okada et al. |
| 5,927,895 | A | 7/1999 | Watanabe |
| 6,007,122 | A | 12/1999 | Linder et al. |
| 6,042,159 | A | 3/2000 | Spitzley et al. |
| 6,241,294 | B1 | 6/2001 | Young et al. |
| 6,264,257 | B1 | 7/2001 | Meinke |
| 6,712,409 | B2 | 3/2004 | Monig |
| 6,971,688 | B2 | 12/2005 | Drysdale et al. |
| 7,070,212 | B2 | 7/2006 | Spurr |

(Continued)

FOREIGN PATENT DOCUMENTS

| | | | |
|---|---|---|---|
| DE | 19837662 | A1 | 4/1999 |
| DE | 10002215 | C1 | 10/2001 |

(Continued)

*Primary Examiner* — Alyson M Merlino

(74) *Attorney, Agent, or Firm* — Raymond Coppiellie; Price Heneveld LLP

(57) ABSTRACT

A vehicle door includes a door structure having an interior space and a ramp disposed within the interior space. The vehicle door further includes a latch and a handle that is pivotably connected to the door structure. The handle includes a pair of inwardly and forwardly extending hooks. The vehicle door also includes a cable or other linkage connected to the latch. The cable has a fitting that is pushed along the ramp by the hooks upon pivoting of the handle to thereby shift the cable and unlatch the latch.

9 Claims, 5 Drawing Sheets

(56) References Cited

U.S. PATENT DOCUMENTS

| | | | |
|---|---|---|---|
| 7,097,212 | B2 | 8/2006 | Willats et al. |
| 7,481,468 | B2 | 1/2009 | Merideth et al. |
| 7,635,151 | B2 | 12/2009 | Rodawold, Jr. et al. |
| 7,686,355 | B2 | 3/2010 | Jankowski et al. |
| 7,810,852 | B2 | 10/2010 | Alacqua et al. |
| 8,029,032 | B1 | 10/2011 | Yang |
| 8,152,209 | B2 | 4/2012 | Lee |
| 8,303,004 | B2 | 11/2012 | Lee et al. |
| 8,366,159 | B2 | 2/2013 | Patel |
| 8,616,611 | B2 | 12/2013 | Schidan et al. |
| 8,701,817 | B2 | 4/2014 | Schoen |
| 8,814,232 | B2 | 8/2014 | Bertolotti |
| 8,899,640 | B2 | 12/2014 | Bertolotti Potachin |
| 9,115,514 | B2 | 8/2015 | Papanikolaou et al. |
| 9,605,450 | B2 | 3/2017 | Puscas et al. |
| 2005/0184537 | A1 | 8/2005 | Le et al. |
| 2007/0120382 | A1 | 5/2007 | Chevalier |
| 2009/0223263 | A1 | 9/2009 | Puscas et al. |
| 2010/0301618 | A1 | 12/2010 | Costigan et al. |
| 2010/0320777 | A1 | 12/2010 | Jankowski et al. |
| 2013/0056999 | A1 | 3/2013 | Beck |
| 2013/0229022 | A1 | 9/2013 | Lesueur |
| 2013/0233034 | A1 | 9/2013 | Ono et al. |
| 2014/0015263 | A1 | 1/2014 | Da Deppo et al. |
| 2014/0097624 | A1 | 4/2014 | Papanikolaou et al. |
| 2014/0132008 | A1 | 5/2014 | Bendel et al. |
| 2014/0145454 | A1 | 5/2014 | Da Deppo et al. |
| 2014/0367977 | A1 | 12/2014 | Beck et al. |
| 2015/0159408 | A1 | 6/2015 | Hunt et al. |
| 2015/0240537 | A1 | 8/2015 | Cumbo |
| 2015/0337566 | A1 | 11/2015 | Wittelsbuerger et al. |
| 2015/0345188 | A1 | 12/2015 | Puscas et al. |
| 2016/0097223 | A1 | 4/2016 | Rosales et al. |
| 2016/0290015 | A1 | 10/2016 | Puscas et al. |
| 2017/0159329 | A1 | 6/2017 | Puscas et al. |
| 2018/0044947 | A1 | 2/2018 | Manolescu et al. |

FOREIGN PATENT DOCUMENTS

| | | | |
|---|---|---|---|
| DE | 202006011206 | U1 | 11/2007 |
| DE | 102009038612 | A1 | 3/2011 |
| DE | 202010014992 | U1 | 1/2012 |
| DE | 202013103708 | U1 | 11/2014 |
| DE | 102013021521 | A1 | 6/2015 |
| JP | 2011099238 | A | 5/2011 |
| WO | 2013093092 | A1 | 6/2013 |
| WO | 2014188909 | A1 | 11/2014 |

VEHICLE DOOR HANDLE

CROSS-REFERENCE TO RELATED PATENT APPLICATION

This application is a continuation of U.S. patent application Ser. No. 14/289,929, filed May 29, 2014, and entitled "VEHICLE DOOR HANDLE," now U.S. Pat. No. 10,072,448, the entire disclosure of which is incorporated herein by reference.

FIELD OF THE INVENTION

The present invention generally relates to handles for vehicle doors, and particularly, to an exterior door handle providing a simple latch release arrangement.

BACKGROUND OF THE INVENTION

Various types of vehicle doors, latches, and handles have been developed. Known exterior door handles may be mechanically interconnected to a door latch by linkage and/or cables. One known arrangement includes an inertia counterweight, bellcrank lever and related components. However, known door handles and linkages may suffer from various drawbacks.

SUMMARY OF THE INVENTION

One aspect of the present invention is a vehicle door including a door structure having inner and outer sides. A door handle is movably connected to the door structure. The vehicle door further includes a latch mechanism configured to selectively retain the door in a closed position. The vehicle door also includes a ramp having an angled ramp surface extending inwardly from the outer side of the door structure. An elongated flexible member such as a cable includes a first portion or end that is operably connected to the latch mechanism, and a second portion or end that movably engages the angled ramp surface. The door handle includes a connector engaging the elongated flexible member whereby movement of the door handle causes the second portion of the elongated flexible member to move along the angled ramp surface and shift the elongated flexible member to thereby unlatch the latch mechanism.

Another aspect of the present invention is a vehicle door including a door structure having an interior space and a ramp disposed within the interior space. The vehicle door further includes a latch and a handle that is pivotably connected to the door structure. The handle includes a pair of inwardly and forwardly extending hooks. The vehicle door also includes a cable connected to the latch. The cable has a fitting that is pushed along the ramp by the hooks upon pivoting of the handle to thereby shift the cable and unlatch the latch.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
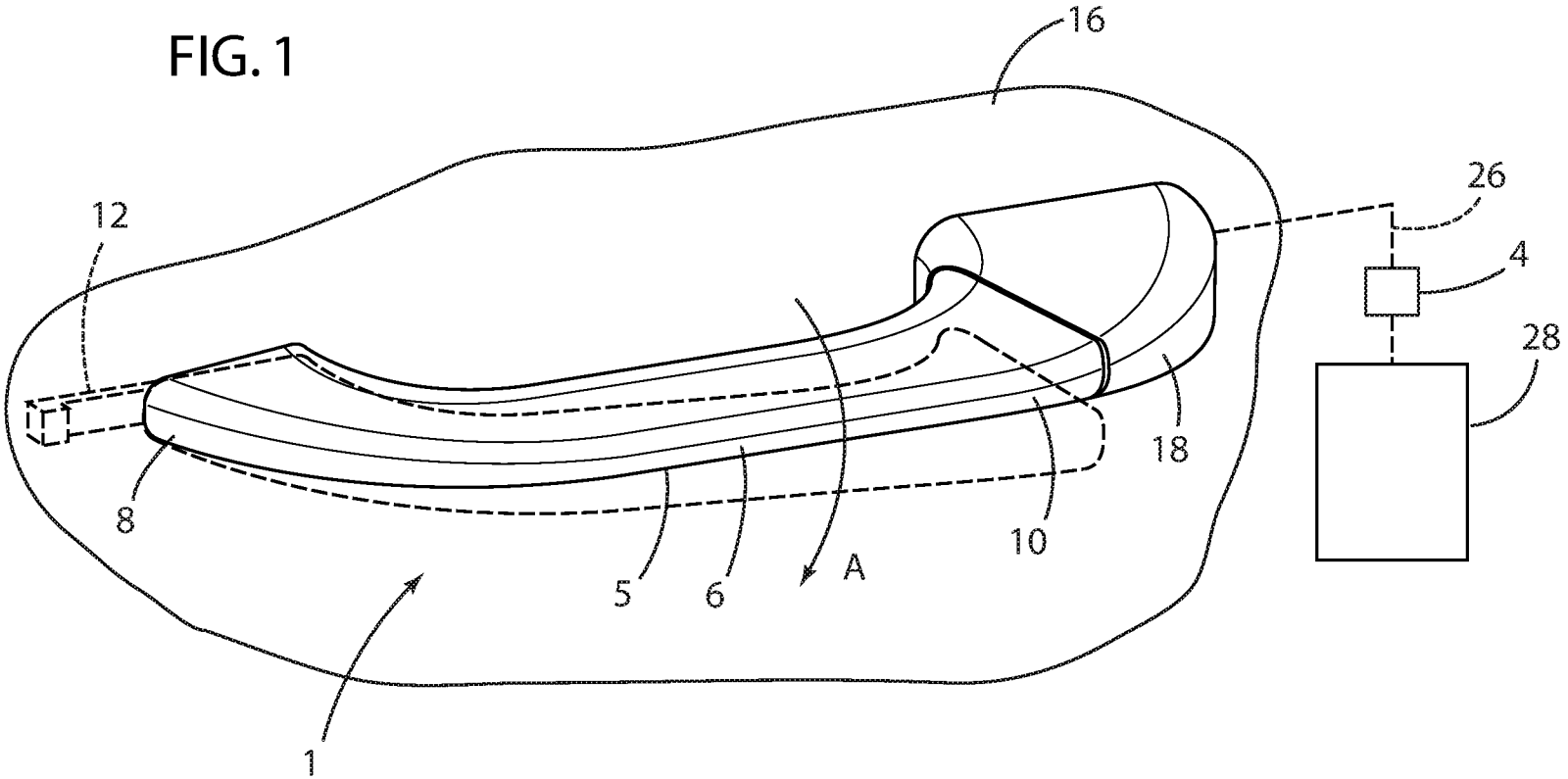
FIG. 1 is a partially fragmentary isometric view of a vehicle door including an exterior door handle according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
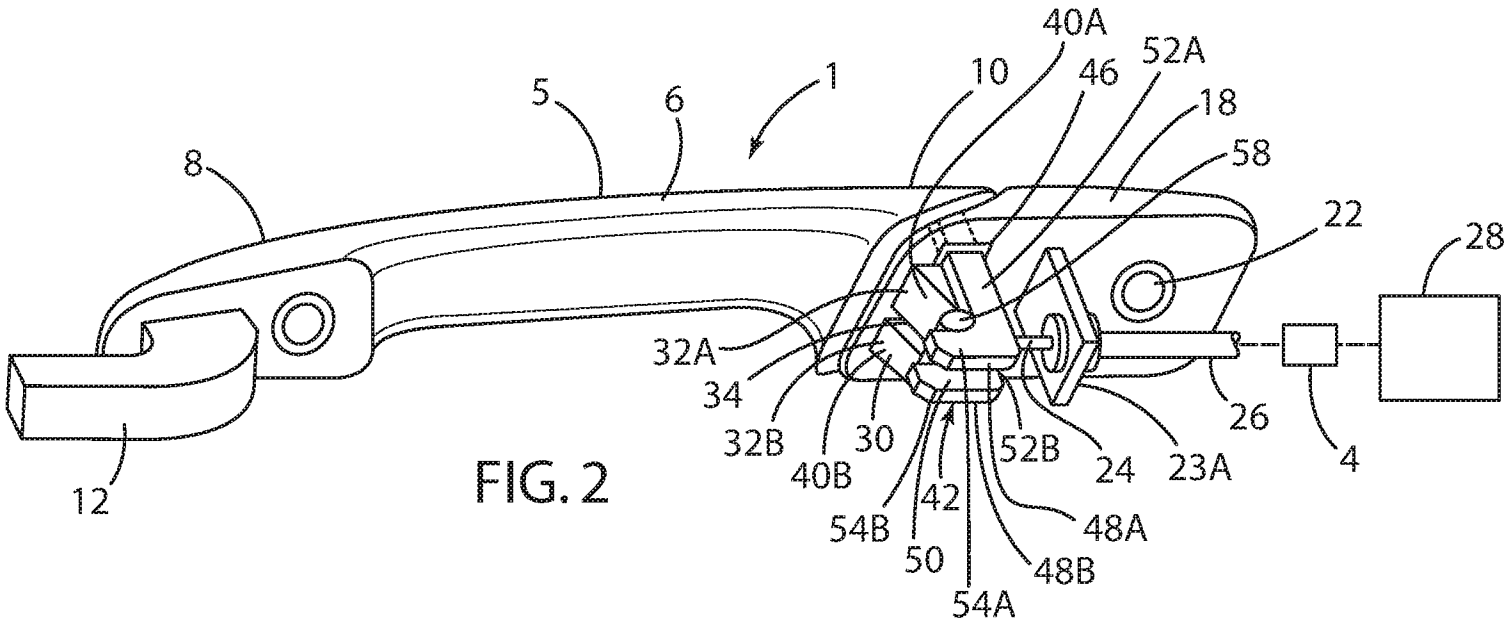
FIG. 2 is a partially schematic isometric view of the door handle and latch of FIG. 1.
Figure 3:
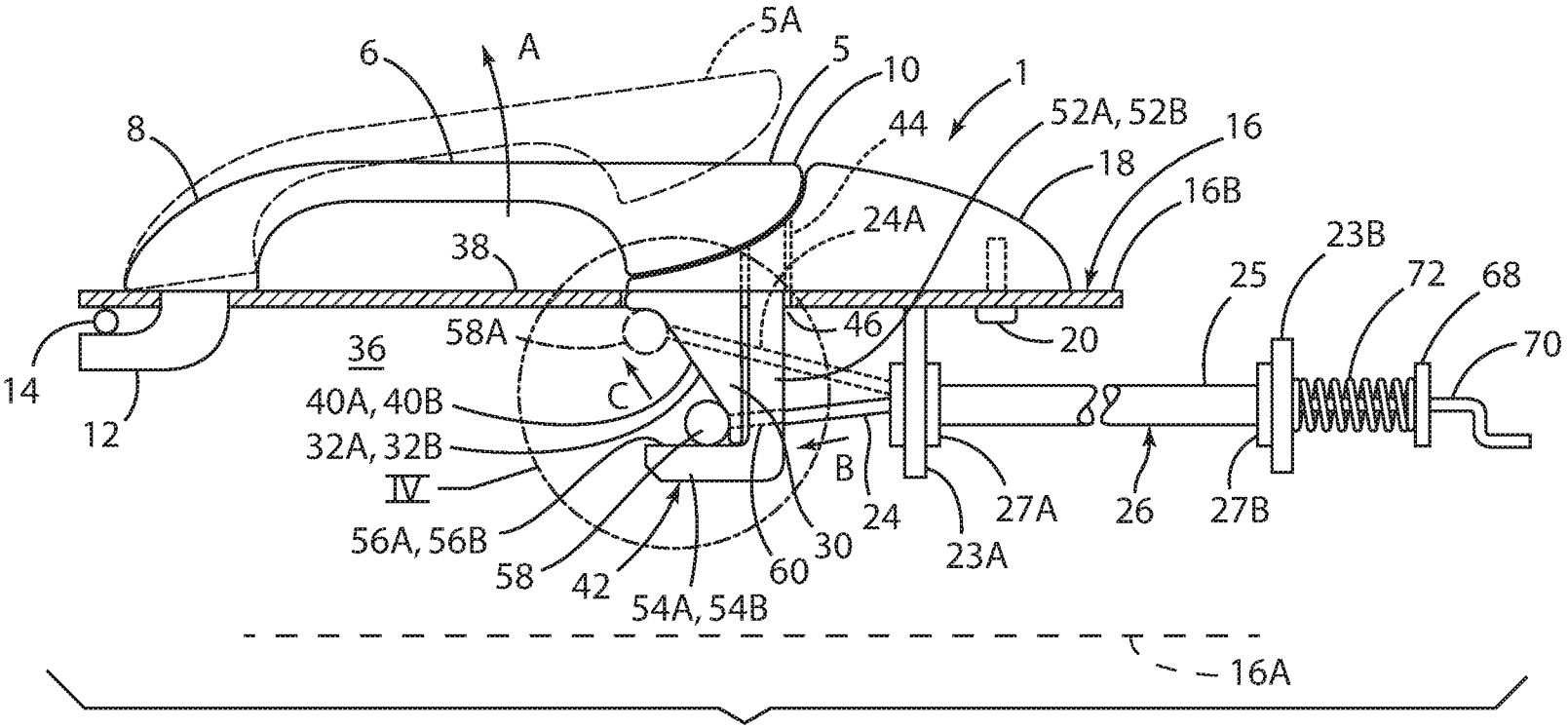
FIG. 3 is a partially fragmentary top plan view of the vehicle door of FIG. 1.

With reference to FIGS. 1 and 2, a vehicle door handle assembly 1 includes a handle member 5 having an elongated central portion 6, a forward end portion 8, and a rearward end portion 10. The forward end 8 may include a hook 12 that movably interconnects handle member 5 to a pivoting connector 14 of a vehicle door structure 16 (see also FIG. 3) in a known manner to thereby permit outward rotational movement of handle 5 in the direction of the arrow "A" (FIG. 3) to an open position "5A" (FIG. 3). Handle assembly 1 may also include a bezel 18 that is secured to door structure 16 by a threaded fastener 20 (FIG. 3) and threaded insert 22 (FIG. 2) or other suitable arrangement. As discussed in more detail below, outward movement of handle member 5 pulls on inner strand 24 of cable 26 to thereby unlatch a latch mechanism 28, and a speed-based cable lock mechanism 4 may be utilized to prevent unlatching of latch mechanism 28 in the event handle 5 is opened rapidly. Latch mechanism 28 may comprise a conventional latch having a catch or claw that engages a post or striker to retain the vehicle door in a closed position, and a pawl that prevents rotation of the claw unless the pawl is shifted to a released position by inner cable strand 24. An example of a typical latch of this type is shown in FIG. 3 of U.S. Pat. No. 8,544,901, the entire contents of which are incorporated by reference. The structure and functions of this type of latch are well known to those skilled in the art, and a detailed description of the latch mechanism 28 is therefore not believed to be required.

Referring again to FIGS. 2 and 3, bezel 18 includes a ramp structure 30 having first and second ramp surfaces 32A and 32B, respectively forming a gap 34 between the surfaces 32A and 32B. The ramp structure 30 generally extends from an outer portion 38 of the door structure 16 into an interior space or cavity 36 defined between inner and outer door panels 16A and 16B, respectively of the vehicle door structure 16. The ramp surfaces 32A and 32B generally face forwardly and inwardly, and include planar central portions 40A and 40B, respectively.

The handle member 5 includes a connector structure 42 that extends inwardly from rearward end portion 10 of handle 5. As shown in FIG. 3, the connector structure 42 extends through an opening 44 in bezel 18, and through an opening 46 in door structure 16. The connector structure 42 may comprise first and second hook structures 48A and 48B (FIG. 2) that are spaced apart to form a gap 50 therebetween. The hooks 40 generally include inwardly-extending base portions 52A and 52B, and forwardly extending end portions 54A and 54B. The forwardly extending portions 54A and 54B define guide surfaces 56A and 56B, respectively. The guide surfaces 56A and 56B may be substantially planar, and face outwardly. However, guide surfaces 56A and 56B could also be concave, convex, or other suitable configuration. In general, the guide surfaces 56A and 56B also extend in a fore-aft direction.

Figure 5:
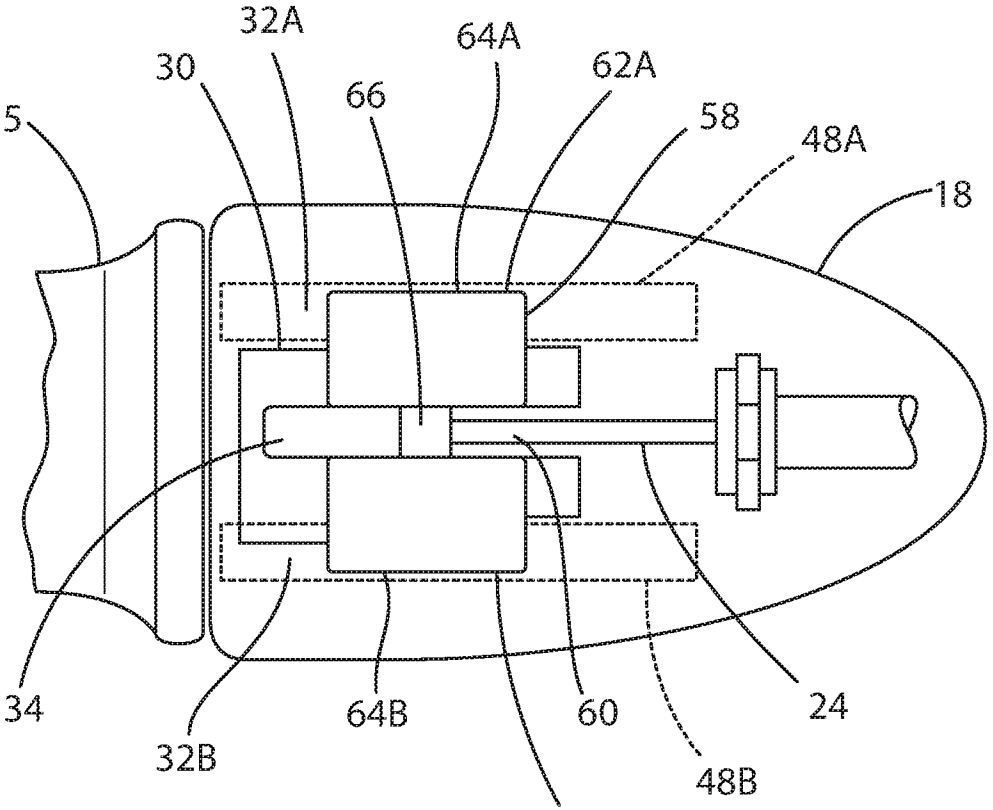
FIG. 5 is a partially fragmentary view of a portion of the handle of FIG. 1.

With reference to FIGS. 2, 3, and 5, an end fitting 58 is secured to an end 60 of inner cable 24. Fitting 58 includes first and second portions 62A and 62B having cylindrical outer surfaces 64A and 64B, respectively. The portions 62A and 62B may be pivotable about a pin 66 that is secured to cable strand 24. The outer surfaces 64A and 64B of fitting 58 contact the ramp surfaces 32A and 32B and simultaneously contact the guide surfaces 56A and 56B as shown in FIG. 3. The connector structure 42/hooks 48A and 48B are shown in dashed lines in FIG. 5 to more clearly illustrate the engagement of end fitting 58 with ramp surfaces 32A and 32B. However, it will be understood that the guide surfaces 56A and 56B of forwardly extending portions 54A and 54B of hooks 48A and 48B, respectively, simultaneously contact the outer surfaces 64A and 64B of fitting 58 and the ramp surfaces 32A and 32B as shown in FIGS. 2 and 3.

Referring again to FIG. 3, cable 26 includes an outer sheath 25 and fittings 27A and 27B that are attached to the outer sheath 25. Fitting 27A is connected to a bracket 23A of door structure 16, and fitting 27B is connected to a second bracket 23B that is also connected to door structure 16. A washer or retainer 68 is secured to an end 70 of inner cable strand 24, and a spring 72 is disposed between second bracket 23B and washer 68 such that movement of inner cable strand 24 in the direction of the arrow "B" compresses spring 72. Thus, spring 72 biases inner cable strand 24 in a direction opposite the arrow B to thereby bias surfaces 64A and 64B of fitting 58 into contact with guide surfaces 56A and 56B, and ramp surfaces 32A and 32B. When assembled, end 70 of inner cable strand 24 is operably connected to the pawl (not shown) of latch mechanism 28 such that movement of inner cable strand 24 in the direction of the arrow B shifts the pawl to unlatch the latch mechanism 28.

Figure 4:
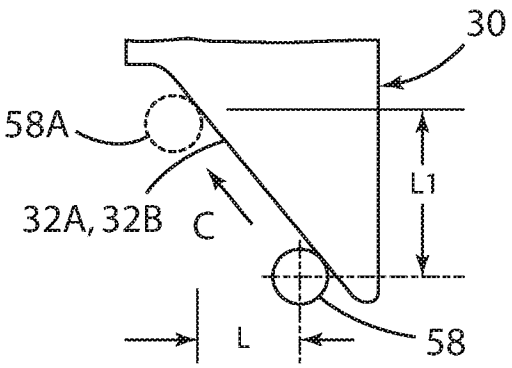
FIG. 4 is an enlarged view of a ramp and angled ramp surface of the vehicle door of FIG. 1.

Referring again to FIG. 3, in use handle 5 is rotated outwardly as shown by the arrow A to the outer or open position 5A. As handle 5 moves outwardly, the hooks 48A and 48B of connector structure 42 move outwardly and move the end fitting 58 in the direction of the arrow "C" to the position 58A, with inner cable strand 24 moving to the position 24A. In general, the fitting 58 moves outwardly a distance "L1" (FIG. 4), and forwardly by an amount "L." The angle and size of ramp structure 30 can be configured as required to provide the necessary length of travel of inner cable strand 24. Due to the angled ramp surfaces 32A and 32B, inner cable strand 24 shifts longitudinally as shown by the arrow B as end fitting 58 moves in the direction of the arrow C. The longitudinal shifting of inner cables strand 24 moves the end 70 of inner cable strand 24, thereby unlatching the latch mechanism 28. As the handle 5 is returned to the closed position (i.e. handle 5 is moved in a direction opposite the arrow A), the fitting 58 travels in a direction opposite the arrow C, and spring 72 creates tension on cable strand 24, thereby ensuring that end fitting 58 remains in contact with ramp surfaces 32A and 32B and with guide surfaces 56A and 56B.

In contrast to known exterior door handles for vehicle doors, the handle assembly 1 of the present invention does not include a bellcrank and other linkage to convert outward movement of the handle into lengthwise movement of the cable. The ramp structure 30 and connector structure 42 are very simple and low cost features. The handle assembly 1 of the present invention also does not include inertia counterweights or the like to prevent outward movement of handle 5 in the event of a side impact on the vehicle. Rather, the handle assembly 1 is utilized in connection with a speed-based cable lock mechanism 4 that prevents rapid movement of inner cable strand 4. The speed-based cable lock 4 may comprise a mechanism as described in detail in U.S. Pat. No. 9,605,560 entitled "VEHICLE DOOR CLOSURE SYSTEM INCLUDING SPEED-BASED LATCH RELEASE," issued on Mar. 28, 2017, the entire contents of which are incorporated by reference.

Figure 6:
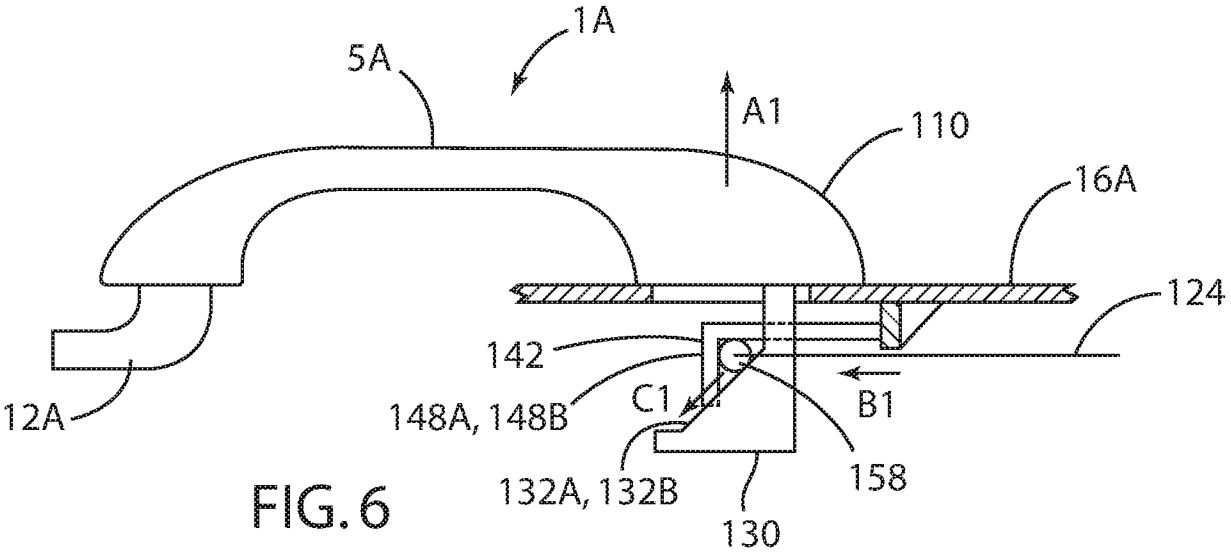
FIG. 6 is a partially fragmentary view of a door handle according to another aspect of the present invention.

With further reference to FIG. 6, a handle 1A according to another aspect of the present invention includes a handle 5A having a hook 12A that rotatably mounts the handle 5A to a door structure 16A in substantially the same manner as described in more detail above in connection with FIGS. 1-5.

Handle assembly 1A includes a ramp structure 130 that extends inwardly from rearward portion 110 of handle 5A to define outwardly and forwardly extending ramp surfaces 132A and 132B. A connector structure 142 including hooks 148A and 148B are secured to door structure 16A. In use, an end fitting 158 of an inner cable strand 124 moves in the direction of the arrow "C1" as end fitting 158 moves along ramp surfaces 132A and 132B. This shifts cable 124 in the direction of arrow "B1" to unlatch a latch mechanism 28 (FIG. 1). Thus, the handle 1A operates in substantially the same manner as the handle 1 described in more detail above in connection with FIGS. 1-5, except that the ramp surfaces 132A and 132B are formed on handle 5A, and connector structure 142 is formed on door structure 16A.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door comprising:

a door structure configured to be movably mounted to a vehicle body for movement between open and closed positions, the door structure including oppositely facing inner and outer sides and an interior space between the inner and outer sides, wherein the inner side is configured to face in an inner direction towards a vehicle interior when the door structure is in a closed position, and wherein the outer side of the door structure includes an outer sheet having an upright outer surface facing in an outward direction away from the vehicle interior when the door structure is movably mounted to the vehicle body, and wherein the outward direction is opposite the inner direction;

an elongated exterior door handle having a pivot structure at a first end and a connecting structure at a second end that is opposite the first end, the elongated exterior door handle having an elongated central portion extending between the opposite first and second ends, wherein the elongated central portion is configured to be grasped by a user, wherein the elongated exterior door handle is pivotably mounted to the door structure by the pivot structure for rotation about a generally vertical axis that passes through the pivot structure, wherein the generally vertical axis is directly adjacent the first end of the elongated exterior door handle, wherein the entirety of the connecting structure is located at the second end of the elongated exterior door handle, and wherein the entirety of the elongated central portion is between the pivot structure and the connecting structure, and wherein the elongated exterior door handle is configured to pivot outwardly in the outward direction from a closed position, in which the second end is located directly adjacent the outer sheet, to an open position, in which the second end is spaced outwardly away from the outer sheet;

wherein the connecting structure has a base portion at the second end of the elongated exterior door handle and attached thereto, wherein the base portion is disposed on the upright outer surface of the outer sheet, the connecting structure including a central portion extending directly inwardly from the base portion and the second end through an opening in the outer sheet, the connecting structure including an inner end portion that is disposed in the interior space when the elongated exterior door handle is in the open and closed positions, the inner end portion including a pair of outwardly-facing guide surfaces that face in the outward direction when the elongated exterior door handle is in the closed position;

a latch mechanism configured to selectively retain the door structure in the closed position;

a ramp fixed to the door structure, the ramp having an angled ramp surface disposed in the interior space directly adjacent the second end of the elongated exterior door handle and directly adjacent the opening in the outer sheet when the elongated exterior door handle is in the closed position;

an elongated linkage having a first portion that is operably connected to the latch mechanism, and a fitting simultaneously contacting the outwardly-facing guide surfaces of the inner end portion of the connecting structure and the angled ramp surface; and wherein outward movement of the elongated central portion of the elongated exterior door handle causes the second end of the elongated exterior door handle to pivot about the pivot axis such that the entirety of the connecting structure moves outwardly in the outward direction, and contact points of the outwardly-facing guide surfaces of the connecting structure that are in contact with the fitting also move outwardly within the interior space in the same outward direction as the elongated central portion of the elongated exterior door handle and in the same outward direction as the second end of the elongated exterior door handle, and wherein the fitting is moved along the outward-facing guide surfaces and along the angled ramp surface due to the pivoting of the elongated exterior door handle from the closed position to the open position and causes the elongated linkage to shift longitudinally to unlatch the latch mechanism.

2. The vehicle door of claim 1, wherein:

the angled ramp surface includes first and second ramp surface portions having a gap therebetween.

3. The vehicle door of claim 1, wherein:

the fitting includes at least one cylindrical outer surface that contacts the angled ramp surface and the outwardly-facing guide surfaces.

4. The vehicle door of claim 1, wherein:

the elongated linkage comprises a cable.

5. A vehicle door comprising:

a door structure comprising an exterior panel on an exterior side of the door structure, the door structure having a ramp;

a latch;

an elongated exterior door handle located on the exterior side of the door structure and pivoting about a first end pivotably connected to the door structure and having at least one hook located at a second end opposite the first end, the elongated exterior door handle having an elongated central portion extending between the opposite first and second ends, wherein the elongated central portion is configured to be grasped by a user; and a cable connected to the latch and having a fitting contacting a ramp surface of the ramp and moving along the ramp surface while in contact therewith, the fitting simultaneously contacting and moving along a guide surface of the at least one hook, whereby the fitting remains in simultaneous contact with both the ramp surface and the guide surface while the fitting simultaneously moves along the ramp surface and the guide surface as the at least one hook moves relative to the door structure upon pivoting of the elongated handle to shift the cable and unlatch the latch.

6. The vehicle door of claim 5, wherein:

the ramp is generally planar.

7. The vehicle door of claim 6, wherein:

the generally planar ramp surface faces forwardly and inwardly.

8. A vehicle door comprising:

a structure having a ramp;

a latch;

an elongated exterior door handle pivoting about a first end pivotably connected to the structure and having a pair of hooks located at a second end opposite the first end, the elongated exterior door handle having an elongated central portion extending between the opposite first and second ends, wherein the elongated central portion is configured to be grasped by a user;

a cable connected to the latch and having a fitting contacting the ramp and the hooks as the hooks move relative to the structure upon pivoting of the handle to shift the cable and unlatch the latch; and the hooks include forwardly extending end portions having guide surfaces, and wherein the fitting simultaneously contacts both guide surfaces and the ramp and moves along both guide surfaces while remaining in simultaneous contact with both guide surfaces and while simultaneously contacting the ramp as the handle pivots outwardly from a closed position to an opened position so as to move the hooks in an outward direction.

9. The vehicle door of claim 8, wherein:

the guide surfaces of the hooks are substantially planar.

* * * * *